United States Patent [19]

Olivieri

[11] Patent Number: 4,789,178

[45] Date of Patent: Dec. 6, 1988

[54] TREAD FOR THE SOLES OF LONG-DISTANCE SKI BOOTS

[75] Inventor: Oliviero Olivieri, Montebelluna, Italy

[73] Assignee: Icaro Olivieri & C. SpA, Montebelluna, Italy

[21] Appl. No.: 47,476

[22] Filed: May 11, 1987

[30] Foreign Application Priority Data

May 22, 1986 [IT] Italy ..... 83360 A/86

[51] Int. Cl.[4] ..... A63C 9/20

[52] U.S. Cl. ..... 280/615

[58] Field of Search ..... 280/614, 615, 611, 607

[56] References Cited

U.S. PATENT DOCUMENTS 4,487,427 12/1984 Salomon ..... 280/615

FOREIGN PATENT DOCUMENTS 370335 3/1983 Austria .

3115618 3/1982 Fed. Rep. of Germany ..... 280/615

3518457 5/1985 Fed. Rep. of Germany ..... 280/615

*Primary Examiner*—John J. Love

*Assistant Examiner*—Michael Mar

*Attorney, Agent, or Firm*—Wegner & Bretschneider

[57] ABSTRACT

Tread for the soles of long-distance ski boots (12), the tread consisting of grooves cooperating with mating ridges, the grooves and ridges being comprised in a sole (16) and in a plate (13) which is fitted to or forms part of a long-distance ski (10), the grooves (19–20) diverging from each other in the direction of the heel of the boot.

8 Claims, 3 Drawing Sheets

TREAD FOR THE SOLES OF LONG-DISTANCE SKI BOOTS

This invention concerns treads for the soles of long-distance ski boots. To be more exact, the invention concerns a coordinated system consisting of the sole of long-distance ski boots and of a plate located on or included in long-distance skis.

In particular, the invention concerns the above coordinated system designed preferably, but not essentially, to obtain the greatest efficiency in using the side step or skater's step.

Coordinated systems consisting of a special conformation of the sole or heel of a ski boot in cooperation with an appropriate plate fitted to or machined on a long-distance ski are known.

In particular, systems are known which provide in the soles of long-distance ski boots one or more substantially parallel, lengthwise grooves which cooperate with relative ridges included on such plates.

An example can be found in CH PS No. 619.147.

These known types have been developed side by side with the evolution of skiing techniques and have become established with modern long-distance skiing steps.

The so-called skater's step is more and more of interest among long-distance skiing steps to amateurs and sportsmen. This step is made by alternating the directional action on one ski or the other, while the thrust action is performed with the other ski, which is oriented at a given angle to the direction of travel with its vertex upstream and is caused to slide along a certain distance towards the outside of the skiing track.

This so-called skater's step is the namesake of the step performed in skating, mainly while applying thrust, precisely owing to the likeness between the two movements.

However, the skater's step calls for a lengthwise control of the ski and at the same time a suitable grip between ski and boot, so that the lateral thrust at an angle has to be transmitted completely to the ski and therefore results in greater stability and speed.

The present conformation, as shown in the example of CH PS 619.147, does not make possible a full and correct transfer of the thrusts nor a proper control of the ski.

In view of the above cited problem and, more generally, the problem of proper control of the ski in all positions and in view also of the need to lighten the ski attachment while keeping the thrust undiminished, the present applicant has designed, tested and embodied this invention.

According to the invention two diverging grooves with their vertex located in the neighbourhood positioned between the end of the boot corresponding with the ski attachment and the inner end of the toes of the skier are included in the sole of a skiing boot.

The divergence of the grooves may be symmetrical to the lengthwise axis of the sole of the boot or symmetrical to the lengthwise vertical plane of the skier's foot.

According to a variant the divergence is differentiated as between the groove running on the inner side of the sole and that running on the outer side of the sole in a substantially horizontal plane.

In another variant the divergent grooves are two plus two in number, and these pairs may be parallel to each other or have a common vertex or a vertex in the neighborhood of a common value.

In a further variant the triangle formed by the outer lines of the grooves is wholly removed so as to form a so-called one single hollow.

In yet another variant the embodiments cited above are replaced by counterpart embodiments, that is to say, a solid portion is provided where a hollow or groove was described above, and a hollow is provided where a solid portion was described above.

The depth of the grooves varies lengthwise but their mean depth is constant.

In a variant the mean depth of the grooves is differentiated.

In another variant the grooves according to the invention may cooperate with one or two grooves running substantially lengthwise along the boot.

In this case too the lengthwise grooves may be replaced in a variant by their counterpart ridges.

The grooves cooperate with mating ridges included on the ski or on an appropriate plate fitted to the ski.

If the grooves on the boot are replaced with counterpart ridges, then the grooves will in fact be provided in the plate or ski and the ridges will be provided on the sole of the boot.

In the description hereinafter we shall describe only a case where the grooves are included in the soles and the ridges are included on the ski, but the counterpart variant shall be understood to be comprised in the examples, namely with grooves in the ski and ridges on the boots.

The description and claims therefore include in the indication of grooves and ridges the counterpart embodiment too.

The invention is therefore embodied with a tread for the soles of long-distance ski boots, the tread consisting of grooves cooperating with mating ridges, the grooves and ridges being comprised in a sole and in a plate which is fitted to or forms part of a long-distance ski, the tread being characterized in that the grooves diverge from each other in the direction of the heel of the boot.

The attached figures, which are given as a non-restrictive example, show the following:

FIG. 1 shows a lengthwise vertical section of a boot according to the invention;

FIG. 2 gives a three-dimensional view of a part of a sole of a skiing boot according to the invention;

FIG. 3 gives a three-dimensional view of a plate suitable to cooperate with the sole of FIG. 2;

Figure 1:
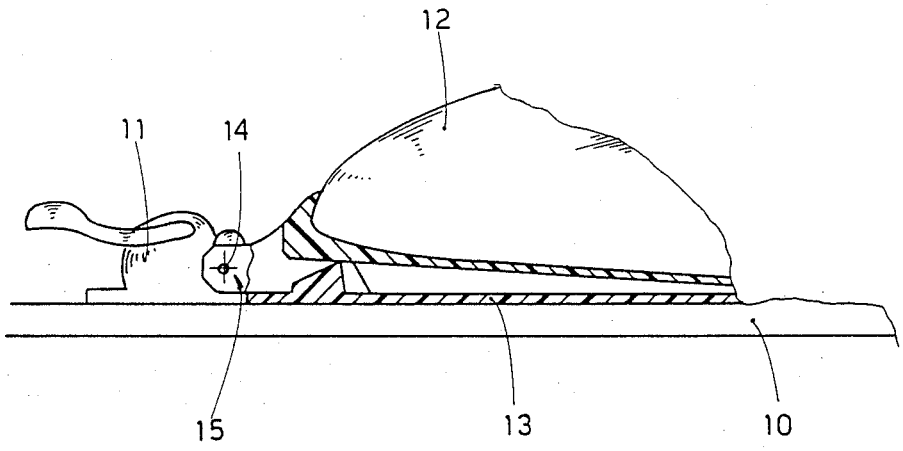
Figure 2:
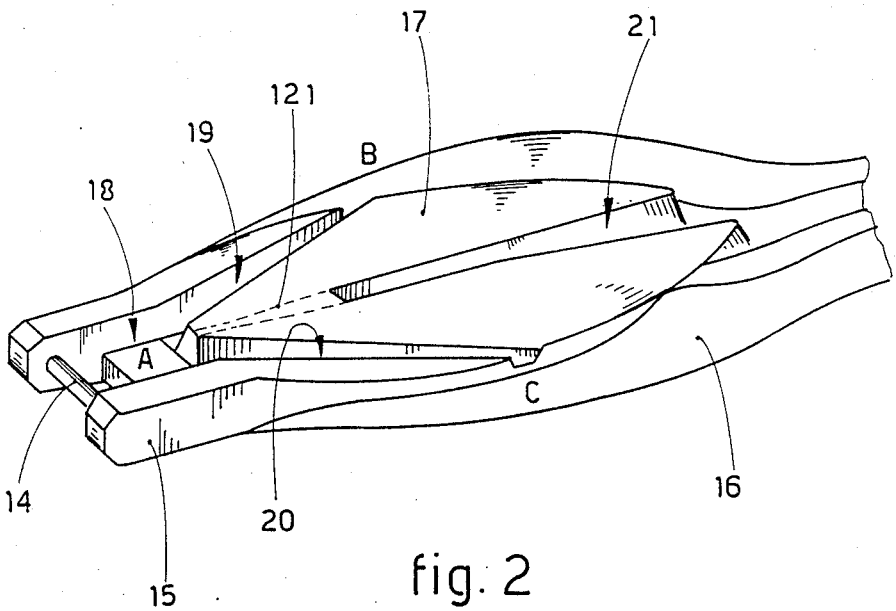

A ski 10 comprises an attachment 11 and a plate 13.

A bridge 14 included in frontal protrusions 15 of a boot 12 is secured in the attachment 11.

The attachment 11, bridge 14 and frontal protrusions 15 are shown for descriptive purposes and are not obligatory since they may be of any type.

The plate 13 too may be independent or an integral part of the ski 10.

The boot 12 comprises a sole 16 with a frontal support surface 17, which may possess grained patterns, teeth, lines, hollows, etc. to improve the general grip on the ski.

A frontal hollow 18 from which there depart grooves 19 and 20 in the example shown is positioned at the front of the support surface 17.

Figure 3:
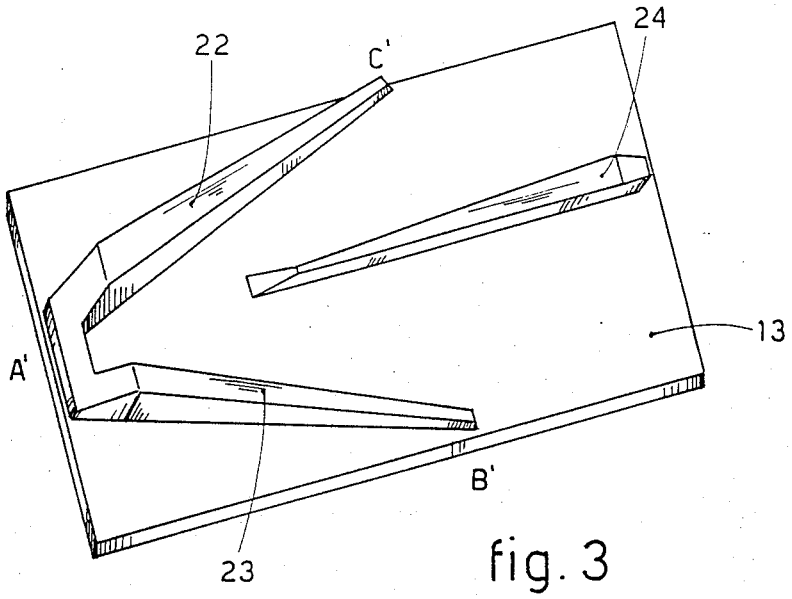
Figure 4:
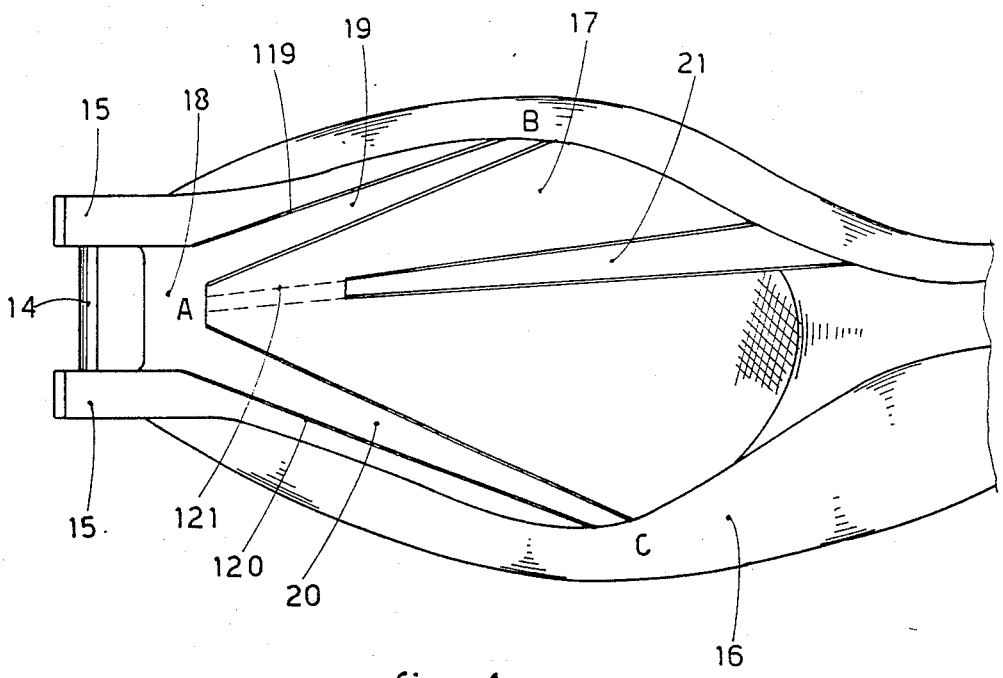
FIG. 4 shows the sole of FIG. 2 in a plan view.

The groove 19 runs on the inner horizontal side of the sole 16, whereas the groove 20 runs on the outer horizontal side of the sole. As can be seen in FIG. 3, grooves 19, 20 preferably decrease in depth from their anterior end to their posterior end.

Figure 5:
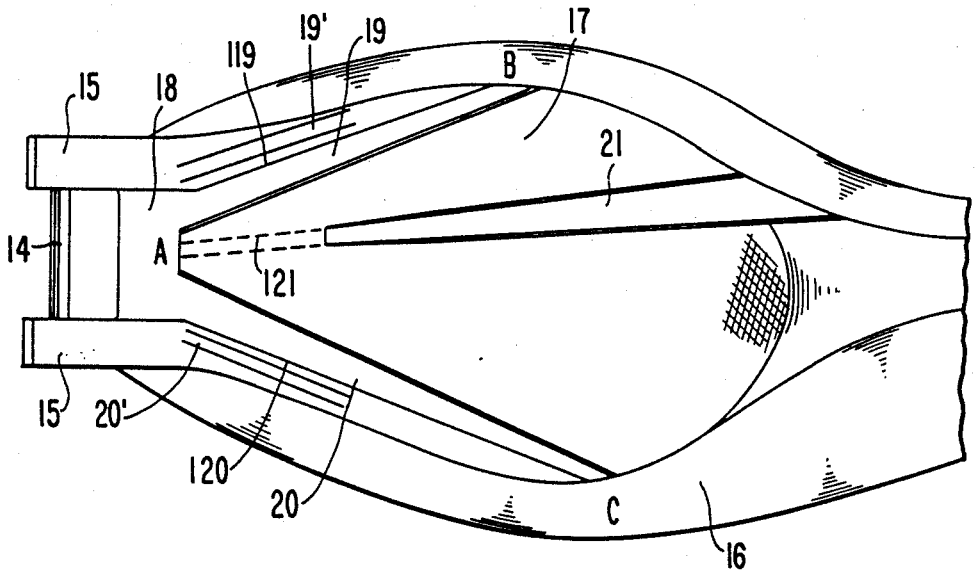
FIG. 5 shows a further embodiment of the sole in FIG. 2 in plan view.

In a variant twin grooves 19', 20' are provided in cooperation with the grooves 19 and 20 as seen in FIG. 5.

In a first idea of an embodiment the grooves 19-20 are parallel to the respective twin grooves.

In a variant of such first idea the twin grooves lie at an angle to the respective grooves 19-20.

At least one lengthwise groove 21, which may reach by 121 the frontal hollow 18, may be included in cooperation with the divergent grooves 19-20.

In a variant the tract of sole or support surface 17 positioned in the neighborhood of a triangle defined here by the vertices A, B and C and relating to the grooves 19-20, for example, is removed so as to obtain one single hollow having as its sides the outer sides 119-120 of the grooves 19-20 respectively, so that the support surface 17 lies on a different plane within such triangle.

An analogous mating triangle with vertices A', B' and C' on the ski will coincide with the above triangle A, B and C.

The plate 13, which comprises an outer ridge 22, an inner ridge 23 and, in a variant, one or more lengthwise ridges 24 too, cooperates with the support surface in the example shown. Ridges 22, 23 preferably decrease in height, in a manner similar to grooves 19, 20.

The grooves 19-20, together with any relative twin grooves and the relative mating ridges 22-23, diverge from each other with their vertex located in the front area of the toe of the boot in correspondence with the attachment of the bridge 14.

Such vertex may be positioned further backwards as far as the neighbourhood of the position of the toes of the skier.

As we said earlier, ridges may be provided on the sole instead of the grooves, and grooves may be provided in the ski instead of the ridges, thus obtaining an embodiment which is the counterpart of the embodiments described above.

I claim:

1. A system for binding the soles of a long distance ski boot to a ski so that the lateral thrust during skating steps is efficiently transferred from the boot to the ski, said system comprising:

a long distance ski boot including:

a bridge formed laterally across the anterior portion of said ski boot, said bridge being releasably secured to said ski by attachment means;

a sole, said sole having at least a first and a second divergent elongated groove formed therein, the vertex of said grooves being located adjacent said bridge;

a plate coupled to the long distance ski, said plate having at least a first and a second divergent elongated ridge formed therein for mating with said grooves, thereby securing said ski boot with said plate; and wherein said grooves decrease in depth and said ridges decrease in height from their vertices to their posterior ends.

2. A system as in claim 1, wherein the divergence of said grooves and said ridges is symmetrical.

3. A system as in claim 1, wherein the divergence of said grooves and said ridges is asymmetrical.

4.A system as in claim 1, further comprising a third groove parallel to said first groove and a fourth groove parallel to said second groove.

5. A system as in claim 1, wherein a triangular portion formed between the ends of said grooves and said vertex is hollowed, the sides of said triangular portion diverging toward the posterior of said boot.

6. A system as in claim 1, further comprising at least one substantially lengthwise groove disposed between said first and second grooves.

7. A system for binding the soles of a long distance ski boot to a ski so that the lateral thrust during skating steps is efficiently transferred from the boot to the ski, said system comprising:

a long distance ski boot including:

a bridge formed laterally across the anterior portion of said ski boot, said bridge being releasably secured to said ski by attachment means;

a sole, said sole having at least first and second posteriorly divergent elongated grooves formed therein and a frontal hollow portion interconnecting the anterior ends of said grooves, said frontal hollow portion being located adjacent said bridge; and a plate coupled to the long distance ski, said plate having at least first and second divergent elongated ridges formed therein, said ridges being interconnected by a frontal ridge portion for mating with said grooves and said frontal hollow portion, thereby securing said ski boot with said plate.

8. A system as in claim 7, wherein said grooves decrease in depth and said ridges decrease in height from their posterior to the anterior ends.

* * * * *